US009589544B2

(12) United States Patent
Song et al.

(10) Patent No.: US 9,589,544 B2
(45) Date of Patent: Mar. 7, 2017

(54) LIQUID CRYSTAL DISPLAY AND DRIVING METHOD THEREOF

(75) Inventors: Jang-Kun Song, Seoul (KR); Dong-Won Park, Seoul (KR)

(73) Assignee: SAMSUNG DISPLAY CO., LTD., Yongin, Gyeonggi-do (KR)

( * ) Notice: Subject to any disclaimer, the term of this patent is extended or adjusted under 35 U.S.C. 154(b) by 1670 days.

(21) Appl. No.: 12/054,921

(22) Filed: Mar. 25, 2008

(65) Prior Publication Data

US 2008/0211755 A1 Sep. 4, 2008

Related U.S. Application Data

(63) Continuation of application No. 10/817,885, filed on Apr. 6, 2004, now Pat. No. 7,362,296.

(30) Foreign Application Priority Data

Apr. 7, 2003 (KR) ..... 2003-21638
Sep. 4, 2003 (KR) ..... 2003-61880
Sep. 29, 2003 (KR) ..... 2003-67298

(51) Int. Cl.

| | |
|---|---|
| ***G09G 3/36*** | (2006.01) |
| ***G09G 5/395*** | (2006.01) |
| ***G09G 3/20*** | (2006.01) |
| *G09G 5/06* | (2006.01) |
| *G09G 5/397* | (2006.01) |

(52) U.S. Cl.

CPC ..... *G09G 5/395* (2013.01); *G09G 3/2011* (2013.01); *G09G 3/3648* (2013.01); *G09G 3/2018* (2013.01); *G09G 3/3688* (2013.01); *G09G 3/3696* (2013.01); *G09G 5/06* (2013.01); *G09G 5/397* (2013.01); *G09G 2310/027* (2013.01); *G09G 2310/06* (2013.01); *G09G 2320/0242* (2013.01); *G09G 2320/0252* (2013.01); *G09G 2320/0276* (2013.01); *G09G 2340/0428* (2013.01); *G09G 2340/16* (2013.01)

(58) Field of Classification Search

CPC ... G09G 2320/0276; G09G 2340/0428; G09G 2340/16

USPC ..... 345/89, 94–96, 102

See application file for complete search history.

(56) References Cited

U.S. PATENT DOCUMENTS 5,528,257 A 6/1996 Okumura et al.
6,304,300 B1 10/2001 Warren et al.
(Continued)

FOREIGN PATENT DOCUMENTS

EP 0525527 A3 2/1992
EP 0525527 A2 2/1993
(Continued)

*Primary Examiner* — William Boddie
*Assistant Examiner* — Leonid Shapiro
(74) *Attorney, Agent, or Firm* — F. Chau & Associates, LLC.

(57) ABSTRACT

A method of optimizing pixel signals for a liquid crystal display includes receiving the first, second and third pixel signals for the (n−1), (n) and (n+1)th frames. The first and second pixel signals are compared to determine if the second pixel signal requires overshooting or undershooting. The second and third pixel signals are compared to determine if the second pixel signal requires to be increased for pre-titling. The second pixel signal is compensated accordingly, thereby increasing liquid crystal response time.

8 Claims, 15 Drawing Sheets

(56) References Cited

U.S. PATENT DOCUMENTS

| | | | | |
|---|---|---|---|---|
| 6,765,551 | B2 * | 7/2004 | Nakano | G09G 3/2011 345/690 |
| 6,873,312 | B2 * | 3/2005 | Matsueda | 345/98 |
| 6,930,663 | B2 * | 8/2005 | Sekiya et al. | 345/87 |
| 7,202,882 | B2 * | 4/2007 | Morita | G09G 3/3611 345/534 |
| 7,457,471 | B2 * | 11/2008 | Song et al. | 382/236 |
| 2001/0038372 | A1 | 11/2001 | Lee | |
| 2002/0135724 | A1 | 9/2002 | Chen et al. | |
| 2003/0222836 | A1 * | 12/2003 | Wong | 345/87 |
| 2004/0012551 | A1 * | 1/2004 | Ishii | 345/87 |

FOREIGN PATENT DOCUMENTS

| | | |
|---|---|---|
| JP | 03-174186 | 7/1991 |
| JP | 07-129133 | 5/1995 |
| JP | 07-334123 | 12/1995 |
| JP | 11-272236 | 10/1999 |
| JP | 2002-062850 | 2/2002 |
| JP | 2004-220022 | 8/2004 |
| JP | 2004-287139 | 10/2004 |
| WO | 03007287 | 1/2003 |

* cited by examiner

LIQUID CRYSTAL DISPLAY AND DRIVING METHOD THEREOF

CROSS-REFERENCE TO RELATED APPLICATIONS

This is a continuation application of U.S. application Ser. No. 10/817,885, filed on Apr. 6, 2004, now U.S. Pat. No. 7,362,296 the disclosure of which is incorporated by reference herein in its entirety, and which, in turn, claims foreign priority upon Korean Patent Application No. 2003-21638 filed on Apr. 7, 2003, Korean Patent Application No. 2003-61880 filed on Sep. 4, 2003 and Korean Patent Application No. 2003-67298 filed on Sep. 29, 2003, the contents of which are incorporated herein by reference in their entirety.

BACKGROUND OF THE INVENTION

Field of the Invention

The present invention relates to a driving method for a liquid crystal display (LCD) device, more particularly to a driving method for enhancing liquid crystal response speed.

Background Description

In order to reduce liquid crystal response time, it has been proposed to generate a compensate target pixel voltage for the present frame from a target pixel voltage of the present frame and a target pixel voltage of the previous frame and apply the compensated target pixel voltage to a corresponding pixel electrode. For example, U.S. patent application Ser. No. 09/773,603 describes a driving method for an LCD device, in which, when the target pixel voltage of the present frame is different from that of the previous frame, a data voltage is compensated to be greater than the target pixel voltage of the present frame ("overshooting") and the compensated data voltage is applied to the pixel electrode. This "overshooting" driving method reduces liquid crystal response time because the compensated target pixel voltage applies stronger electric field to the pixel electrode.

However, the "overshooting" is not fully effective in increasing liquid crystal response time for a patterned vertical alignment (PVA) type LCD. A PVA type LCD has patterns (e.g., apertures and/or protrusions) formed on one or both substrates. When a target pixel voltage is applied to the pixel electrode, fringe fields are formed near the patterns and the liquid crystal molecules are laid toward expected directions by the fringe fields. However, for the liquid crystal molecules disposed far from the fringe fields, it takes longer to be laid towards the expected directions because they tend to be laid initially toward undesired directions.

Therefore, there is a need for a more effective method for driving liquid crystal to reduce the liquid crystal response time.

SUMMARY OF THE INVENTION

In an aspect of the invention, a method for optimizing pixel signals for a liquid crystal display is provided. The method includes steps of receiving the first pixel signal for the (n−i)th frame and receiving the second pixel signal for the (n)th frame. It is determined if the first pixel signal and the second pixel signal satisfy a first predetermined condition. The second pixel signal is compensated if the first predetermined condition is satisfied. The third pixel signal for the (n+j)th frame is received. It is determined if the second pixel signal and the third pixel signal satisfy a second predetermined condition. The second pixel signal is compensated if the second predetermined condition is satisfied.

Another aspect of the invention is a method for optimizing pixel signals for a liquid crystal display. The first pixel signal for the (n−i)th frame and the second pixel signal for the (n)th frame are received. It is determined if the first pixel signal and the second pixel signal meet a predetermined condition. The first pixel signal is compensated for pretilting liquid crystal molecules if the predetermined condition is satisfied.

Another aspect of the invention is a liquid crystal display (LCD) including the first frame memory storing the first pixel signal for the (n−i)th frame. The second frame memory is provided to store the second pixel signal for the (n)th frame. A compensator is provided to receive the first pixel signal, the second pixel signal and the third pixel signal for the (n+j)th frame. The compensator determines if the first pixel signal and the second pixel signal satisfy the first predetermined condition and if the second pixel signal and the third pixel signal satisfy the second predetermined condition. The compensator performs the first optimization to the second pixel signal if the first predetermined condition is satisfied and/or the second optimization if the second predetermined condition is satisfied.

Another aspect of the invention is a method of optimizing pixel signals for a liquid crystal display. The method includes the steps of receiving the first pixel signal for the (n−i)th frame and the second pixel signal for the (n)th frame. It is determined if the first pixel signal and the second pixel signal satisfy the first predetermined condition. The first pixel signal is compensated if the first predetermined condition is satisfied. The first pixel signal or the compensated first pixel signal is stored. It is determined if the first pixel signal or the compensated first pixel signal and the second pixel signal satisfy the second predetermined condition. The second pixel signal is compensated if the second predetermined condition is satisfied.

Another aspect of the invention is a liquid crystal display (LCD) including a compensator that receives the first pixel signal for the (n−i)th frame and the second pixel signal for the (n)the frame. The compensator determines if the first pixel signal and the second pixel signal satisfy the first predetermined condition and compensates the first pixel signal if the first predetermined condition is satisfied. A frame memory is provided to store the compensated first pixel signal. The compensator determines if the first pixel signal or the compensated first pixel signal and the second pixel signal satisfy the second predetermined condition and compensates the second pixel signal if the second predetermined condition is satisfied.

Another aspect of the invention is a method of optimizing pixel signals for a liquid crystal display. The method includes the steps of receiving the first pixel signal for the (n−i)th frame and the second pixel signal for the (n)th frame. It is determined if the first pixel signal and the second pixel signal satisfy the first predetermined condition. The second pixel signal is compensated if the first predetermined condition is satisfied. The compensated second pixel signal is stored and the third pixel signal for the (n+j)th frame is received. It is determined if the second pixel signal or the compensated second pixel signal and the third pixel signal satisfy the second predetermined condition. The third pixel signal is determined if the second predetermined condition is satisfied and the second pixel signal is not compensated.

Another aspect of the invention is a liquid crystal display (LCD). The LCD includes a compensator receiving the first pixel signal for the (n−i)th frame, the second pixel signal for the (n)th frame and the third pixel signal for the (n+j)th frame. The compensator determines if the first pixel signal and the second pixel signal satisfy the first predetermined condition and compensates the second pixel signal if the first predetermined condition is satisfied. A frame memory is provided to store the compensated second pixel signal. The compensator determines if the second pixel signal or the compensated second pixel signal and the third signal satisfy the second predetermined condition and compensates the third pixel signal if the second predetermined condition is satisfied and the second pixel signal is not compensated.

Another aspect of the invention is a method of optimizing pixel signals for a liquid crystal display. The method includes the steps of receiving the first pixel signal for the (n−i)th frame and the second pixel signal for the (n)th frame, the first pixel signal and the second pixel signal corresponding to first gray levels of a first gray scale having an X number of gray levels. The first gray levels of the first pixel signal and the second pixel signal are converted to second gray levels of a second gray scale having a Y number of gray levels and at least one overshooting gray level, wherein X is greater than Y. It is determined if the second gray levels of the first pixel signal and the second pixel signal satisfy a predetermined condition. The second gray level of the second pixel signal is compensated if the predetermined condition is satisfied.

Another aspect of the invention is a liquid crystal display (LCD) including a converter. The converter receives the first pixel signal for the (n−i)th frame and the second pixel signal for the (n)th frame, the first pixel signal and the second pixel signal corresponding to first gray levels of the first gray scale having an X number of gray levels. The converter converts the first gray levels of the first pixel signal and the second pixel signal to second gray levels of the second gray scale having a Y number of gray levels and at least one overshooting gray level. A compensator is provided to determine if the second gray levels of the first pixel signal and the second pixel signal satisfy a predetermined condition and compensates the second gray level of the second pixel signal if the predetermined condition is satisfied.

BRIEF DESCRIPTION OF THE DRAWINGS

The invention will be better understood from the following detailed description of embodiments of reference to the drawings.

DETAILED DESCRIPTION OF EMBODIMENTS OF THE INVENTION

Figure 1:
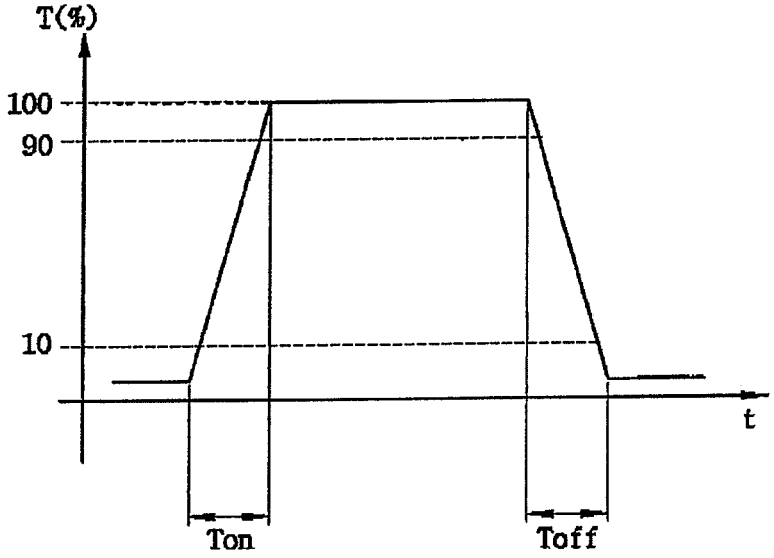
FIG. 1 depicts a relationship between pixel transmittance (T) and liquid crystal response time (t).
Figure 2:
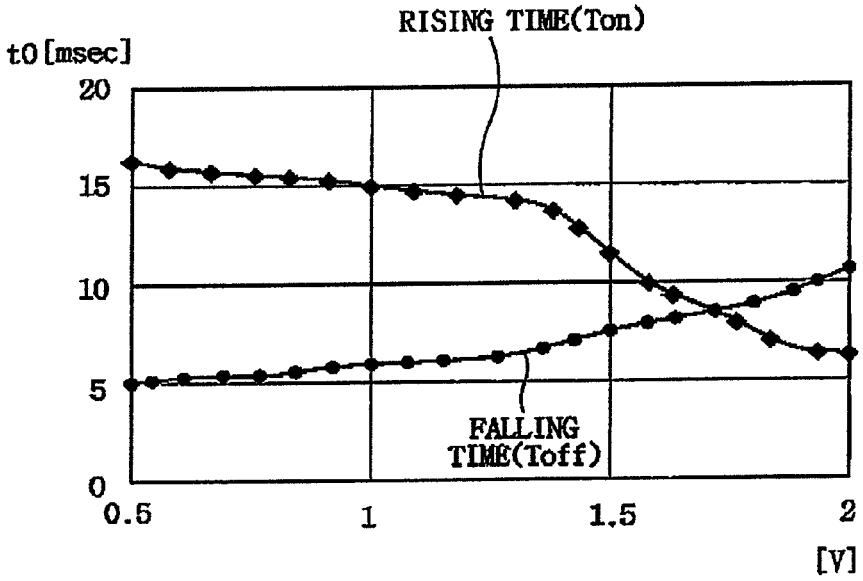
FIG. 2 depicts a relationship between pixel voltage (V) and pixel on/off time (t0).

FIG. 1 shows a pixel transmittance T changed from approximately 0% (black) to approximately 100% (white) during a turn-on time period $T_{on}$ and changed from approximately 100% (white) to approximately 0% (black) a turn-off time period $T_{off}$. FIG. 2 shows how a gray level voltage for displaying black (hereafter, "black gray level voltage") influences the turn-on time period $T_{on}$ and the turn-off time period $T_{off}$. As shown therein, the turn-on time period $T_{on}$ is reduced when the black gray level voltage is increased because liquid crystal molecules are pre-tilted by the increased black gray level voltage. The pre-titled liquid crystal molecules are laid more quickly when a gray level voltage for displaying white (hereafter, "white gray level voltage") is subsequently applied to the pixel. This shortens the liquid crystal response time. It is not feasible to set the black gray scale voltage V too high because, as shown in FIG. 2, if the black gray scale voltage V increases, the turn-off time period $T_{off}$ also increases. Thus, if the black gray scale voltage ranges between about 0.5V to about 1.5V, a voltage between about 2 V to about 3.5 V is applied as a pre-tilting voltage.

Figure 3:
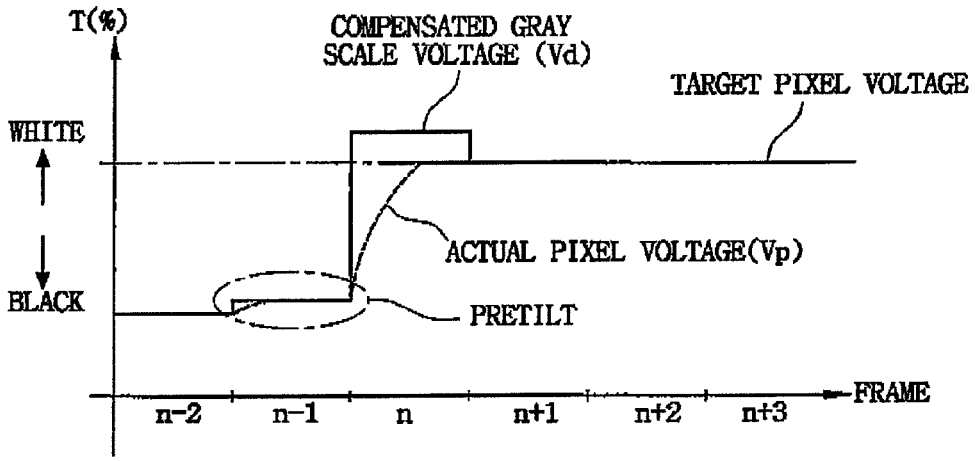
FIG. 3 depicts a pixel voltage signal compensated for pretilt and overshooting, in accordance with an embodiment of the present invention.

FIG. 3 shows a compensated gray scale voltage Vd according to an embodiment of the present invention. When black is displayed during the (n−1)th frame and white is displayed during the (n)th frame, a pre-tilt voltage is applied during the (n−1)th frame. For example, if the black gray scale voltage ranges between about 0.5V to about 1.5V, the pre-tilt voltage is preferably ranges from about 2V to about 3.5V.

In order to decide if the gray level signal for the current frame requires compensation for pre-tilting, the gray level signals for the current frame and the next frame are compared to determine if these gray level signals satisfy a predetermined condition. For example, the predetermined condition would be met if the gray level signal for the current frame corresponds to black and the gray level signal for the next frame corresponds to white. Thus, it is necessary to shift one frame to determine the predetermined condition is satisfied. However, the pre-tilt voltage may be applied to the pixel electrode during the (n−1)th frame only. Subsequently, in the (n)th frame, the input gray level signal is compensated for overshooting. Although there is one frame delay, a length of the frame is too short and such a delay is hardly recognized.

A number of gray levels that constitutes a gray scale or ranges of gray levels corresponding to black or white can vary depending on needs. For better understanding of the invention, it is assumed that a gray scale consists of 256 gray levels (0 to 255), the gray level corresponding to black ranges between 0 to 50th gray levels, and white color corresponds to a gray level between 200th to 255th. The pre-tilt voltage may be a constant value corresponding to black color, even though the degree or the pre-tilt voltage may be varied according to the degree of the gray scale.

Embodiment 1

Figure 4:
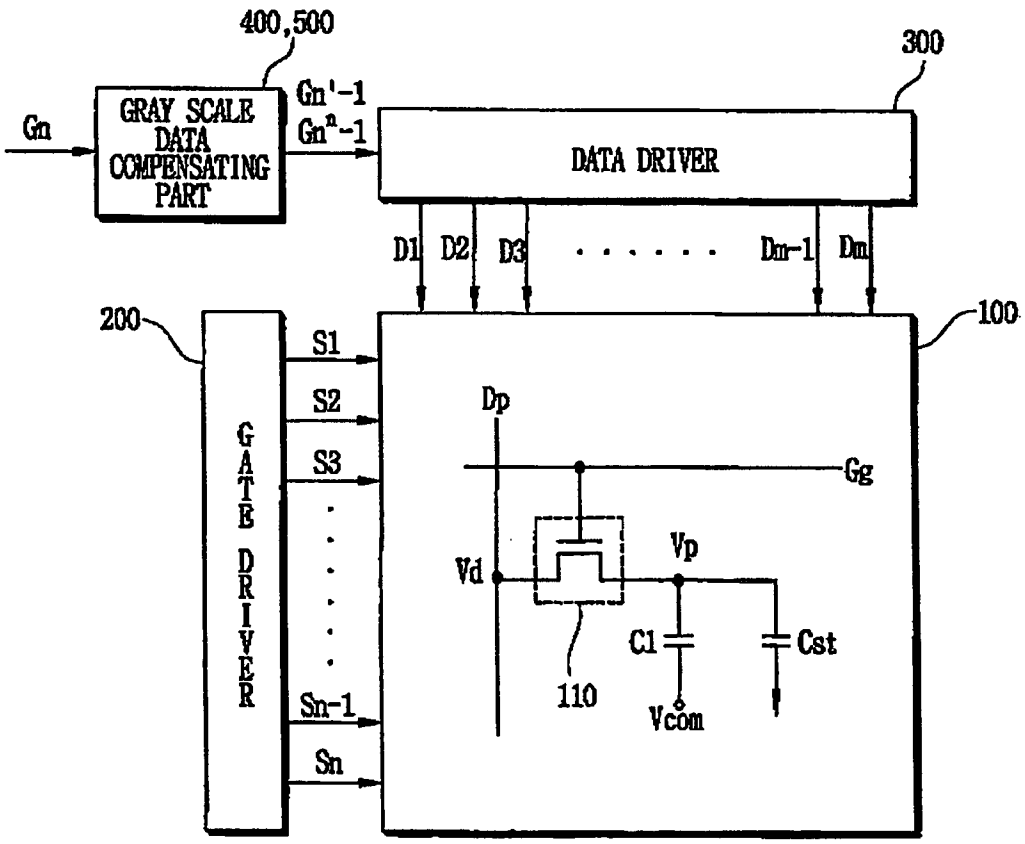
FIG. 4 depicts a block diagram of a liquid crystal displaying including a gray scale data compensating part, in accordance with the first embodiment of the present invention.

FIG. 4 show a block diagram of a liquid crystal display device according to the first embodiment of the present invention. The liquid crystal display device includes a liquid crystal display panel 100, a gate driver 200, a data driver 300 and a gray scale data compensator 400. The liquid crystal display panel can be a vertical alignment (VA) type, patterned vertical alignment (PVA) type or mixed vertical alignment (MVA) type. The gray scale compensator 400 or 500, the data driver 300 and the gate driver 200 function as a driver device for transforming an external signal from an external host (e.g., graphic controller) into an internal signal applied to the liquid crystal display panel 100.

As conventionally known, gate lines Gg (i.e., scan lines) and data lines Dp (i.e., source lines) are formed on the liquid crystal display panel 100. A region surrounded by two neighboring gate lines Gg and two neighboring data lines Dp is defined as a pixel. The pixel includes a thin film transistor 110, a liquid crystal capacitor $C_1$ and a storage capacitor $C_{st}$. The thin film transistor 110 has a gate electrode, a source electrode and a drain electrode. The gate electrode is electrically connected to the gate line Gg. The source electrode is electrically connected to the data line Dp. The drain electrode is electrically connected to the liquid crystal capacitor $C_1$ and a storage capacitor $C_{st}$.

Although FIG. 4 shows the gray scale data compensator 400 is a stand-alone unit, it may be integrated in a graphic card, a liquid crystal display module, a timing controller or a data driver. The gray scale compensator 400 receives a gray scale signal $G_n$ (or a primitive gray scale signal) and generates a compensated gray scale signal $G'_{m-1}$. The gate driver 200 applies gate signals $S_1$ to $S_n$ to the gate line $G_g$, in sequence, to turn on the thin film transistors 110. The data driver 300 receives the compensated gray scale signal (G'm−1) from the gray scale data compensator 400 and applies the compensated gray scale signal (G'm−1) as data signals $D_1$ to $D_m$ to the data lines respectively.

In detail, when a primitive gray scale signal $G_{n-1}$ of the (n−1)th frame is equal to a primitive gray scale signal $G_n$ of the n-th frame, the primitive gray scale signal $G_{n-1}$ is not compensated and the compensated gray scale signal $G'_{n-1}$ would be the same with the primitive gray scale signal $G_{n-1}$. However, when a primitive gray scale signal $G_{n-1}$ for the (n−1)th frame corresponds to dark color (e.g., black) and a primitive gray scale signal $G_n$ of the (n)th frame corresponds to bright color (e.g., white), the a primitive gray scale signal $G_{n-1}$ is compensated to be higher than the primitive gray scale signal Gn−1 and the compensated gray scale signal $G'_{n-1}$ corresponds to a gray scale signal for pre-tilting the liquid crystal molecules. In the (n+1)th frame, an overshoot waveform is applied to the driver 300 as the compensated gray scale signal $G'_n$. The compensated gray scale signal $G'_n$ is obtained by comparing a gray scale signal $G_n$ of the (n)th frame with a gray scale signal $G_{n-1}$ of the (n−1)th frame and a gray scale signal $G_{n-2}$ of (n−2)th frame.

As described above, according to the first embodiment of the present invention, a data voltage (e.g., gray level signal) is compensated and the compensated data voltage is applied to a pixel electrode so that a pixel voltage approaches to a target voltage level more promptly. Therefore, a response time of a liquid crystal molecule decreases without changing a structure of a liquid crystal display panel and without changing a property of liquid crystal molecule.

Embodiment 2

Figure 5:
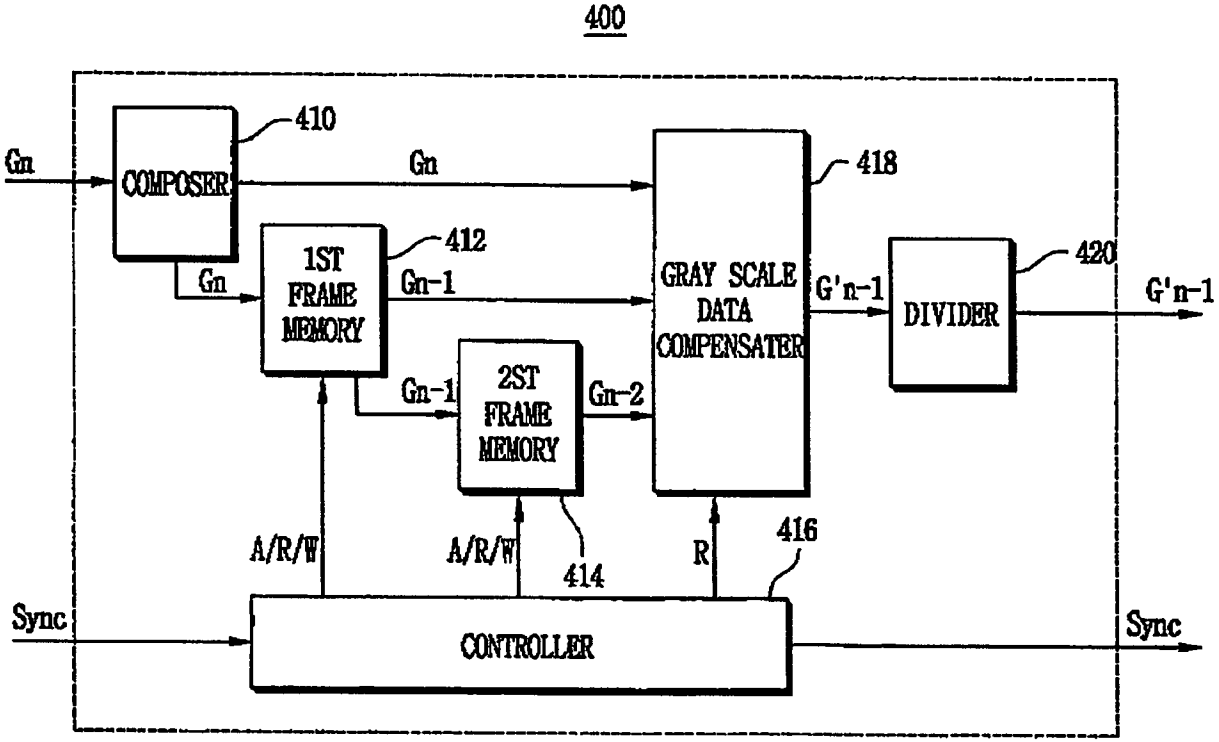
FIG. 5 depicts a block diagram of a gray level compensator, in accordance with the second embodiment of the present invention.

FIG. 5 is a block diagram of a gray scale compensator according to the second embodiment of the present invention. Referring to FIG. 5, a gray scale data compensator 400 has a composer 410, a first frame memory 412, a second frame memory 414, a controller 416, a gray scale compensator 418 and a divider 420. The gray scale data compensator 400 receives a primitive gray scale signal $G_n$ for the (n)th frame and generates a compensated gray scale signal $G'_{n-1}$ for the (n)th frame.

The composer 410 receives a primitive gray scale signal $G_n$ for the (n)th frame from a gray scale signal source (not shown) and transforms a frequency of the data stream so that the gray scale data compensator 400 may process the primitive gray scale signal $G_n$. For example, when the composer 410 receives a 24-bit primitive gray scale signal synchronized with 65 MHz but the gray scale data compensating part 400 can process only a signal that is below 50 MHz, the composer 410 pairs the 24-bit the primitive gray scale signal to form a 48-bit primitive gray scale signal. Then the composer 410 transfers the paired 48-bit primitive gray scale signal to the first frame memory 412 and to the gray scale data compensator 418.

The first frame memory 412 transfers a stored gray scale signal $G_{n-1}$ for the (n−1)th frame to the gray scale compensator 418 and to the second frame memory 414 in response to an address clock signal A and a read clock signal R from a controller 416. Also, the first frame memory 412 stores a gray signal $G_n$ of the (n)th frame in response to the address clock signal A and a write clock signal W from a controller 416. The second frame memory 414 transfers a stored gray scale signal $G_{n-2}$ for the (n−2)th frame to the gray scale compensator 418 in response to the address clock signal A and the read clock signal R from the controller 416. Also, the second frame memory 414 stores the gray scale signal Gn−1 for the (n−1)th frame in response to the address clock signal A and the write clock signal W from the controller 416.

The gray scale data compensator 418 receives the gray scale signal $G_n$ for the (n)th frame from the composer 410, the gray scale signal $G_{n-1}$ for the (n−1)th frame from the first frame generator 412 and the gray scale signal $G_{n-2}$ for the (n−2)th frame from the second frame generator 414 in response to the read clock signal R from the controller 416. Also, the gray scale data compensator 418 generates a compensated gray scale signal $G'_{n-1}$ for the (n−1)th frame by comparing the gray scale signal $G_n$ with the gray scale signal Gn−1 and the gray scale signal Gn−2.

The gray scale data compensator 418 receives the gray scale signal $G_n$ for the (n)th frame and generates the compensated gray scale signal G'n−1 for the (n−1)th frame, which is shifted by one frame. For example, when the primitive gray scale signal $G_n$ for the (n)th frame corresponds to white and the primitive gray scale signal $G_{n-1}$ for the (n−1)th frame corresponds to black, the gray scale data compensator 418 generates a compensated gray scale signal $G'_{n-1}$ for pre-tilting a liquid crystal molecule in (n)th frame. When the primitive gray scale signal $G_n$ of the (n)th frame and the gray scale signal $G_{n-1}$ for the (n−1)th frame correspond to white but the primitive gray scale signal $G_{n-2}$ for the (n−2)th frame corresponds to black, the gray scale data compensator 418 generates a compensated gray scale signal $G'_{n-1}$ having an overshoot wave pattern during the (n−1)th frame.

In detail, a magnitude of the overshoot waveform or undershoot waveform may be determined by applying a predetermined percentage (X %) of the target voltage or adding or subtracting a predetermined value (ΔV1) to or from the target voltage. A magnitude of the pre-tilt voltage may be determined by applying a predetermined percentage (Y %) of target voltage or adding a predetermined value (ΔV2) to the target voltage. For example, when a black gray scale voltage is in the range from about 0.5V to about 1.5V, the pre-tilt voltage may be in the range from about 2 to about 3.5V.

The divider 420 divides the compensated gray scale signal $G'_{n-1}$ and applies it to the data driver 300 of FIG. 4. For example, if the compensated gray scale signal $G'_{n-1}$ is 48-bit, the divided gray scale signal may be 24-bit. When a clock frequency synchronized with the data gray scale signal is different from a clock frequency by which the first and the second frame memory 412 and 414 are accessed, the composer 410 and the divider 420 are utilized. However, when a clock frequency synchronizing the data gray scale signal is substantially equal to a clock frequency with which the first and the second frame memory 412 and 414 operate, the gray scale data compensator 400 does not need to include the composer 410 and the divider 420. Also, alternately, a serializer can be used instead of the divider 420.

The gray scale data compensator 418 may be a digital circuit having a look-up table stored at a read only memory (ROM). The primitive gray scale signal is compensated in accordance with the look-up table. In a real situation, the compensated data voltage for the (n)th frame is not directly proportional to a difference between a primitive voltages for the (n−1)th frame and the (n)th frame. Rather, the compensated data voltage is non-linear to the difference and depends not only on the difference but also on an absolute value of the primitive voltages for the (n−1)th frame and the (n)th frame. Therefore, when a look-up table is used for the gray scale data compensator 418, the gray scale data compensator 418 can have a simpler design.

In this embodiment, the dynamic range of the data voltage are required to be broader than that of the real gray scale voltage. This problem may be solved, when a high voltage integrated circuit (IC) is used, in an analog circuit. However, in a digital circuit, the gray scale level is fixed (or restricted). For example, in a 6-bit (or 64) gray scale level, a portion of the gray scale level should be assigned not for a real gray scale voltage but for a compensated gray scale voltage. Namely, a portion of the gray scale level should be assigned for the compensated gray scale level, so that a gray scale level that is displayed is reduced.

A concept of truncation may be used to avoid reducing the gray scale level. For example, suppose that the liquid crystal molecule is operated in a voltage from about 1V to about 4V, and the compensated voltage is in the range from about 0V to about 8V. Even when the range is divided into 64 levels to compensate the voltage sufficiently, only 30 levels may be used for expressing the gray level. Therefore, when a width of the voltage is lowered to be in the range from about 1V to about 4V and a compensated voltage is higher than 4V, the compensated voltage is truncated to be 4V so that a number of the gray scale level is reduced.

Figure 6:
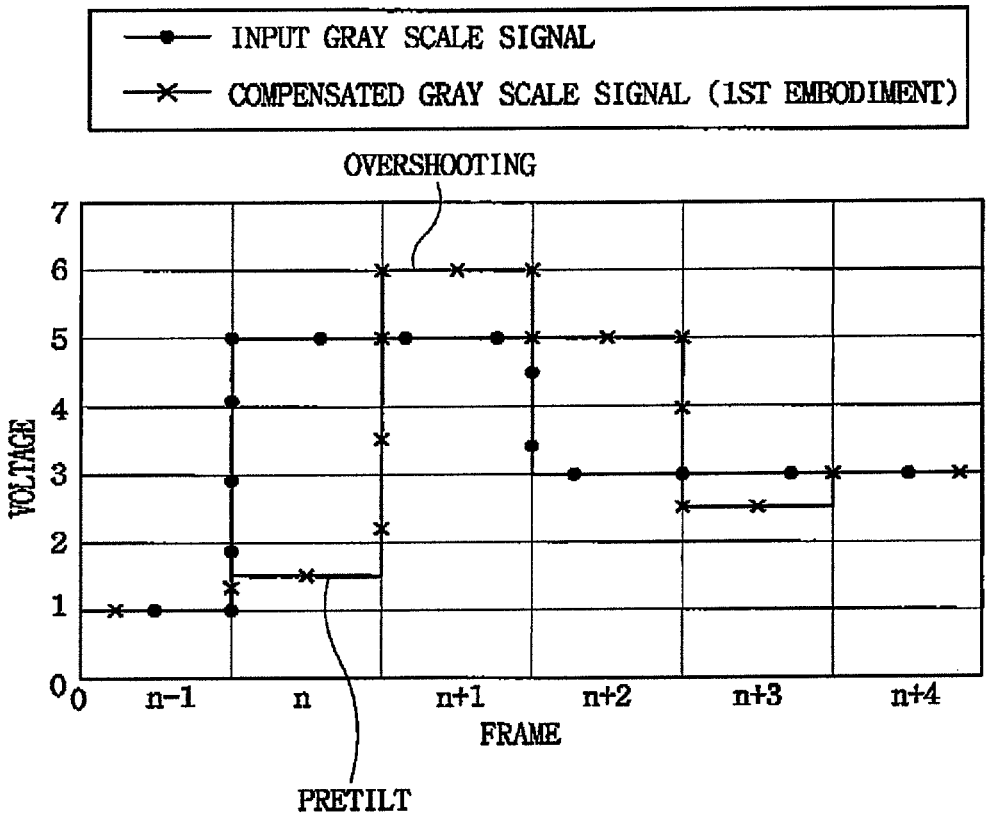
FIG. 6 depicts an input pixel signal and a compensated pixel signal, in accordance with the second embodiment of the present invention.

FIG. 6 is a timing diagram showing an output waveform according to the second embodiment of the present invention. As shown therein, an input gray scale signal is 1V during the (n−1)th frame, 5V during the (n)th frame and the (n+1)th frame and 3V during and after the (n+2)th frame. In response, the compensated gray scale signal of 1.5V corresponding to the input gray scale signal for the (n−1)th frame is applied for the (n)th frame to pre-tilt the liquid crystal molecule. Then the compensated gray scale signal of 6V corresponding to the input gray scale signal for the (n)th frame is applied for the (n+1)th frame and the compensated gray scale signal of 5V corresponding to the input gray scale signal for the (n+1)th frame is applied for the (n+2)th frame. The compensated gray scale signal of 2.5V corresponding to the input gray scale signal for the (n+2)th frame is applied for the (n+3)th frame and the compensated gray scale signal of 3V corresponding to the input gray scale signal for the (n+3)th frame is applied for the (n+4)th frame and the frame thereafter.

In detail, the input gray scale signal for the (n−1)th frame corresponds to black and the input gray scale signal for the (n)th frame corresponds to white. Therefore, a pre-tilt voltage corresponding to the input gray scale signal for the (n−1)th frame is applied during the (n)th frame with one frame delay. Subsequently, an overshoot voltage corresponding to the input gray scale signal for the (n)th frame is applied during the (n+1)th frame with one frame delay. The input gray scale signal for the (n+1)th frame is the same with the input gray scale signal for the (n)th frame. Therefore, the compensated gray scale signal for the (n)th frame corresponding to the input gray scale signal for the (n+1)th frame is the same with the input gray scale signal of the (n+1)th frame. The input gray scale signal for the (n+1)th frame corresponds to white and the input gray scale signal for the (n+2)th frame corresponds to black. Therefore, an undershoot voltage corresponding to the input gray scale signal for the (n+2)th frame is applied during the (n+3)th frame with one frame delay. The input gray scale signal for the (n+3)th frame is the same as the input gray scale signal for the (n+2)th frame. Therefore, the compensated gray scale signal for the (n+4)th frame corresponding to the input gray scale signal for the (n+3)th frame is the same as the input gray scale signal for the (n+3)th frame.

As described above, the compensated gray scale signal is delayed by one frame compared with the input gray scale signal. When the input gray scale signal is changed suddenly from a low voltage that corresponds to black to a high voltage that corresponds to white, the pre-tilt voltage is applied first and then the overshoot voltage is applied. Therefore, the response time of the liquid crystal molecule is reduced.

Embodiment 3

Figure 7:
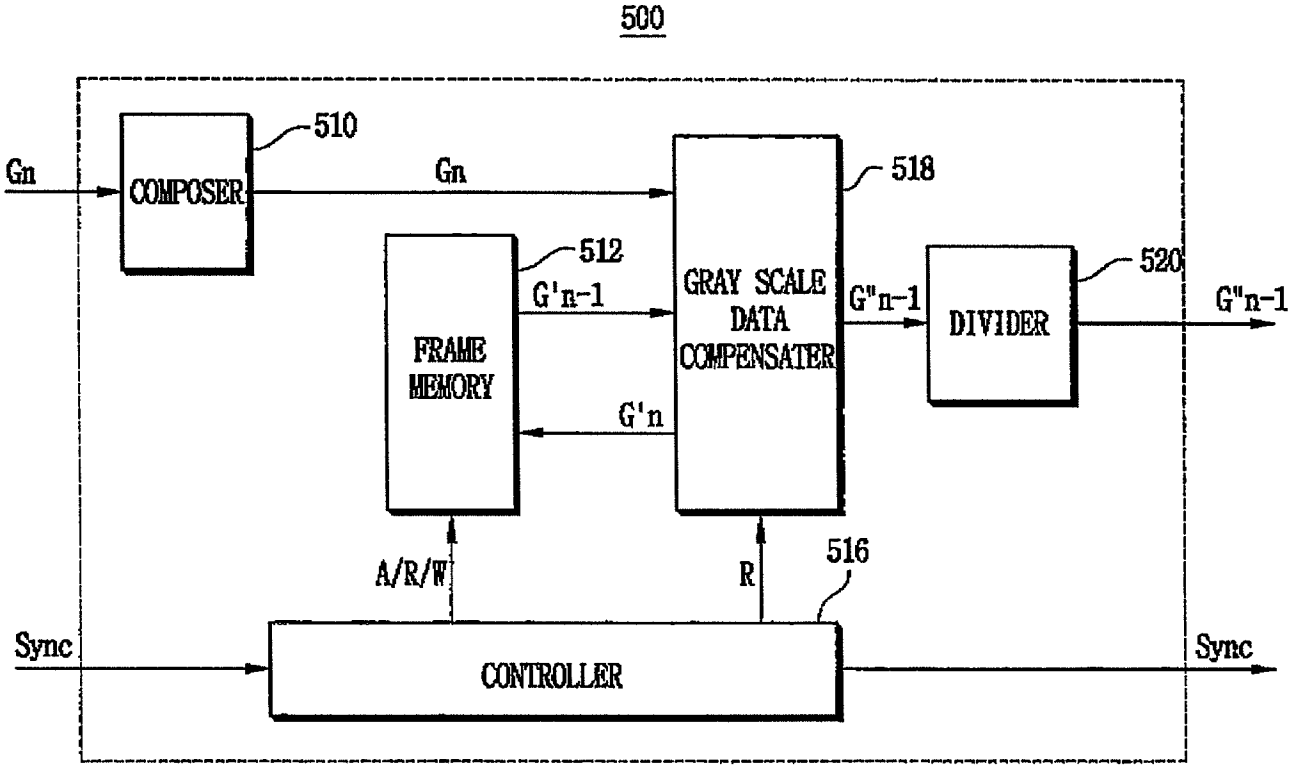
FIG. 7 depicts a block diagram of gray scale compensator, in accordance with the third embodiment of the present invention.

FIG. 7 is a block diagram showing a gray scale compensator according to the third embodiment of the present invention. As shown therein, a gray scale data compensating part 500 includes a composer 510, a single frame memory 512, a controller 516, a gray scale compensator 518 and a divider 520. The gray scale data compensating part 500 receives a primitive gray scale signal $G_n$ for the (n)th frame and generates a compensated gray scale signal $G'_{n-1}$ for the (n)th frame.

The composer 510 is basically the same as the composer 410 shown in FIG. 5. The frame memory 512 transfers the first compensated gray scale signal $G'_{n-1}$ stored in the frame memory 512 to the gray scale data compensator 518 in response to an address clock signal A and read clock signal R from the controller 516. The first compensated gray scale signal $G'_{n-1}$ is formed by considering a primitive compensated gray scale signal Gn−1 and a compensated gray scale signal $G_{n-2}$. Also, the frame memory 512 stores the first compensated gray scale signal $G'_n$ from the gray scale data compensator 518 in response to the address clock signal A and write clock signal W from the controller 516.

The gray scale data compensator 518 receives the first compensated gray scale signal $G'_{n-1}$ from the frame memory 512 in response to the read clock signal R from the controller 516. Also, the gray scale data compensator 518 generates the second compensated gray scale signal $G''_{n-1}$ by comparing the gray scale signal $G_n$ from the composer 510 with the first compensated gray scale signal $G'_{n-1}$ from the frame memory 512. The gray scale data compensator 518 applies the second compensated gray scale signal $G''_{n-1}$ to the divider 520 and applies the first compensated gray scale signal $G'_n$ for the (n)th frame to the frame memory 512.

The first compensated gray scale signal $G'_n$ is generated from a primitive gray scale signal $G_n$ and a primitive gray scale signal $G_{n-1}$ for the (n−1)th frame. For example, when a first compensated gray scale signal $G'_{n-1}$ corresponds to black and a primitive signal $G_n$ corresponds to white, the second compensated $G''_{n-1}$ for pre-tilting liquid crystal molecules is generated for the (n)th frame. When the first compensated gray scale signal G'n−1 corresponds to a pre-tilt signal and a primitive signal $G_n$ corresponds to white, the second compensated $G''_{n-1}$ having an overshoot wave form is generated for the (n)th frame. The divider 520 divides the second compensated gray scale signal $G''_{n-1}$ and applies the divided second gray scale signal $G''_{n-1}$ to the data driver 300 of FIG. 4. For example, when the compensated gray scale signal $G'_{m-1}$ is 48-bit, the divided gray scale signal may be 24-bit. According to the third embodiment of the present invention, the gray scale data compensator 500 of FIG. 4 includes only one frame memory but is still capable of generating the second compensated gray scale signal.

Figure 8:
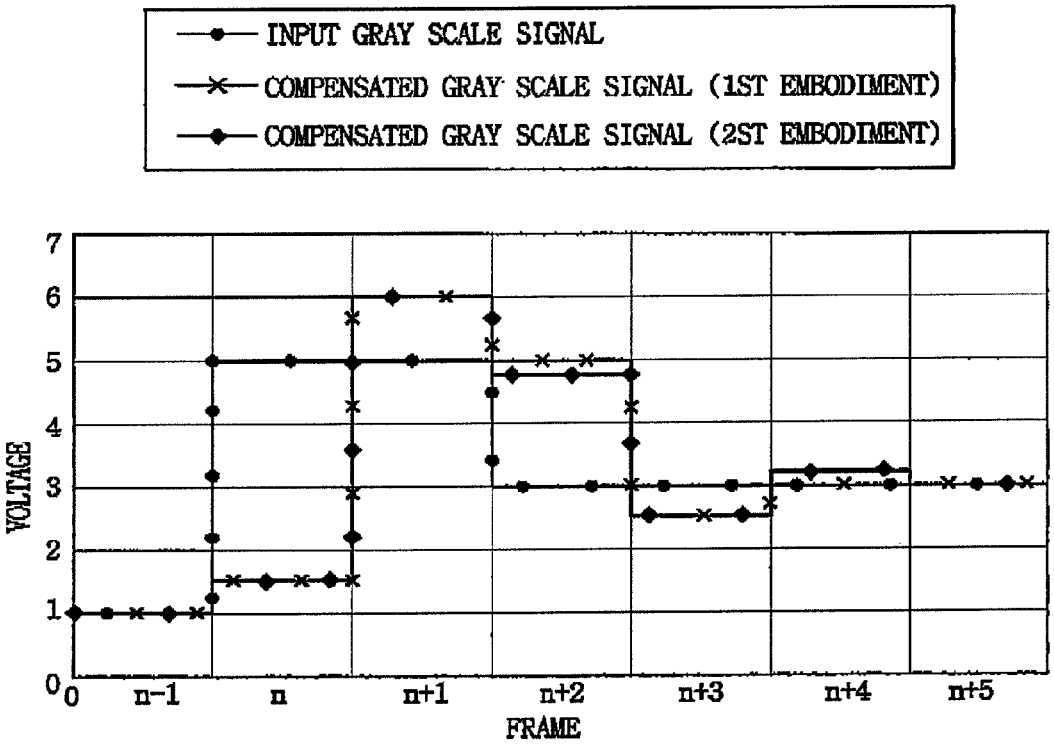
FIG. 8 depicts an input pixel signal and the compensated pixel signals generated by the gray level compensators shown in FIG. 5 and FIG. 7.

FIG. 8 is a timing diagram showing an output waveform according to the third exemplary embodiment of the present invention. As shown therein, an input gray scale signal that is 1V during the (n−1)th frame, 5V during the (n)th frame and the (n+1)th frame and 3V during and after the (n+2)th frame. In response, the compensated gray scale signal maintain 1V during the (n−1)th frame. Then, the compensated gray scale signal of 1.5V corresponding to the input gray scale signal for the (n−1)th frame is generated for the (n)th frame, in order to pre-tilt the liquid crystal molecule. Then the compensated gray scale signal of 6V corresponding to the input gray scale signal for the (n)th frame is generated for the (n+1)th frame and the compensated gray scale signal of 4.8V corresponding to the input gray scale signal for the (n+1)th frame is generated for the (n+2)th frame. The compensated gray scale signal of 2.5V corresponding to the input gray scale signal for the (n+2)th frame is generated for the (n+3)th frame and the compensated gray scale signal of 3.2V corresponding to the input gray scale signal for the (n+3)th frame is generated for the (n+4)th frame. The compensated gray scale signal of 3V corresponding to the input gray scale signal for the (n+4)th frame is generated for the (n+5)th frame.

According to the third embodiment of the present invention, only one frame memory is used. The frame memory does not store a gray scale signal of the present frame. Rather, it stores the first compensated gray scale signal obtained by comparing a gray scale signal of previous frames. The gray scale data compensator generates the second compensated gray scale signal obtained by comparing the gray scale signal of the present frame with the first compensated gray scale signal.

Embodiment 4

In the second embodiment of the present invention, a gray scale signal for the (n−2)th frame and a gray scale signal for the (n−1)th frame are stored and a gray scale signal for the (n)th frame is compared with both of the gray scale signals for the (n−2)th frame and the (n−1)th frame. In the third embodiment of the present invention, the first compensated gray scale signal of the previous frame is stored and a gray scale signal for the (n)th frame is compared with the first compensated gray scale signal of the previous frame. Therefore, reducing the frame memory causes information loss.

Referring again to FIG. 8, the overshoot or undershoot waveforms are formed during the (n+1)th, the (n+2)th, the (n+3)th and the (n+4)th frames successively because the gray scale compensator 518 of FIG. 7 compares the gray scale signal of the present frame not with the gray scale signal for the previous frames but with the first compensated gray scale signal. However, the magnitude of the overshoot or undershoot for the (n+2)th frame and the magnitude of the overshoot or undershoot for the (n+4)th frame are reduced in comparison with a magnitude of the overshoot or undershoot for the (n+1)th frame and the magnitude of the overshoot or undershoot for the (n+3)th frame, respectively. Therefore, the liquid crystal molecule response time is not substantially changed.

However, in the compensated gray scale signal according to the third embodiment, a ripple pattern is generated after an overshoot wave pattern is generate, because the frame memory stores the first compensated gray scale data, not the present gray scale data, and outputs the second compensated gray scale data when pre-tilting or overshooting/undershooting is required. The rippled wave pattern may exceed the objective gray scale signal or the rippled wave pattern may be short to the objective gray scale signal, thereby deteriorating display quality. To solve this problem, a gray scale data compensator that reduces the ripple pattern is disclosed in this embodiment.

Figure 9:
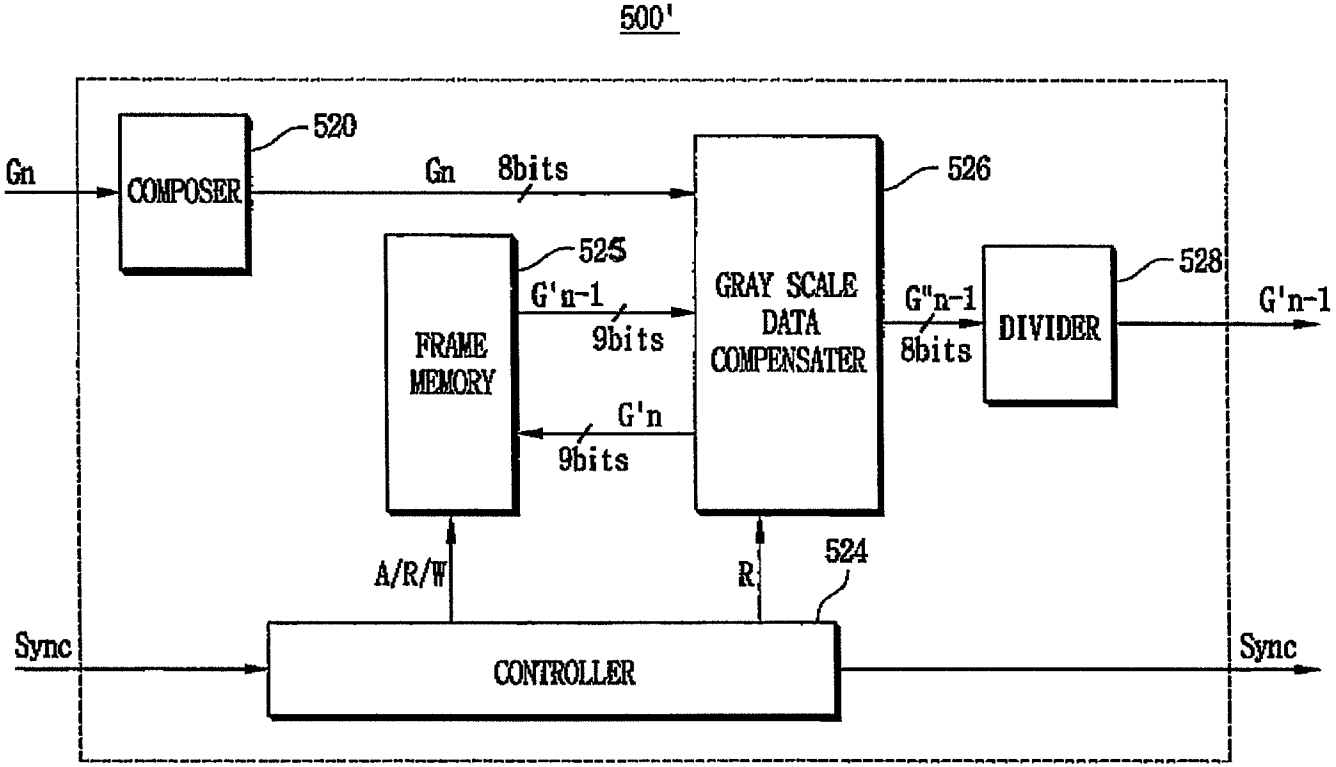
FIG. 9 depicts a block diagram of a gray scale compensator, in accordance with the fourth embodiment of the present invention.

FIG. 9 is a block diagram showing a gray scale compensator 500' according to the fourth embodiment of the present invention. As shown therein, the gray scale compensator 500' has a composer 520, a frame memory 522, a controller 524, a gray scale data compensator 526 and a divider 528. The gray scale compensator 500' receives a primitive gray scale signal $G_n$ for the present frame and outputs a compensated gray scale signal $G'_{n-1}$ for the previous frame.

The composer 520 may be the same with the composer 410 shown in Fig. The frame memory 525 provides the gray scale data compensator 526 with a first compensated gray scale signal $G'_{n-1}$ of the previous frame in response to an address clock signal A and a read clock signal R from the controller 524. Also the frame memory 525 stores the first compensated gray scale signal $G'_n$ in response to the address clock signal A and a write clock signal W from the controller 524. The previous first compensated gray scale signal G'n−1 stored in the frame memory 422 and the present first compensated gray scale signal $G'_n$ include an option signal for over shooting. The option signal may be one bit. When the first compensated gray scale signal $G'_{n-1}$ or $G'_n$ is compensated for overshooting, the option signal is set to 1. When the first compensated gray scale signal $G'_{n-1}$ or $G'_n$ is not compensated, the option signal is set to 0. That is, the option signal stores an information as to whether the first compensated gray scale signal has been compensated for overshooting or not.

The gray scale data compensator 526 generates the second compensated gray scale signal $G''_{n-1}$, which is 8 bits, in response to the read clock signal R from the controller 524 by considering the 8 bits gray scale signal $G_n$ from the composer 520, and the 9 bits first compensated gray scale signal $G'_{n-1}$ from the frame memory 525. Then the gray scale data compensator 526 provides the divider 428 with the second compensated grays scale signal $G''_{n-1}$. Additionally, the gray scale data compensator 526 provides the frame memory 522 with a 9 bits first compensated gray scale signal $G'_n$.

In other words, the gray scale data compensator 528 outputs the second compensated gray scale data signal $G''_{n-1}$ to form an overshoot pattern for the (n)th frame, when the first compensated gray scale signal $G'_{n-1}$ stored in the frame memory 525 is different from the primitive gray scale data signal $G_n$ from the composer 520. The first compensated gray scale signal G'n−1 that is compared with the primitive gray scale signal $G_n$ has only 8 bits excluding a 1 bit for the option signal. The one bit signal is used for preventing continuous overshooting.

When a gray scale signal for the (n−1)th frame corresponds to black and a gray scale signal for the (n)th frame corresponds to white, the gray scale data compensator 526 outputs the second compensated gray scale signal $G''_{n-1}$ for pre-tilting liquid crystal molecules. In this case, the second compensated gray scale signal $G''_{n-1}$ is higher than the gray scale signal for the (n−1)th frame, wherein the first compensated gray scale signal G'n−1 for the (n−1)th frame, which excludes the 1 bit of the option signal, is used while comparing with the primitive gray scale signal $G_n$ for the (n)th frame.

The divider 528 separates the second compensated gray scale signal $G''_{n-1}$ to form a separated compensated gray scale signal $G'_{n-1}$. The separated compensated gray scale signal G'n−1 is applied to the data driver 300 of FIG. 4. For example, the second compensated gray scale signal $G''_{n-1}$ has 48 bits and the separated compensated gray scale signal $G'_{n-1}$ has 24 bit. The composer 520 and the divider 528 may be omitted if unnecessary.

According to the fourth embodiment of the present invention, even when the gray scale data compensator includes only one frame memory, it may generate a compensated gray scale data by considering the gray scale signals of the previous, present and next frames. Additionally, the gray scale data compensator prevents continuous overshoot wave patterns.

In detail, the compensated gray scale data is delayed by one frame in comparison with a primitive gray scale signal. Especially, when a gray scale signal is changed from black (i.e., low voltage level) to white (i.e., high voltage level), a pre-tilting signal is generated, followed by an overshooting signal in order to reduce liquid crystal response time of liquid crystal. Further, after the pre-tilting signal is generated, an option signal of the first compensated gray scale signal stored in the frame memory is activated to prevent overshooting in the next frame. Thus, the primitive gray scale signal that is not compensated is outputted to prevent rippling of the compensated gray scale signal.

Figure 10:
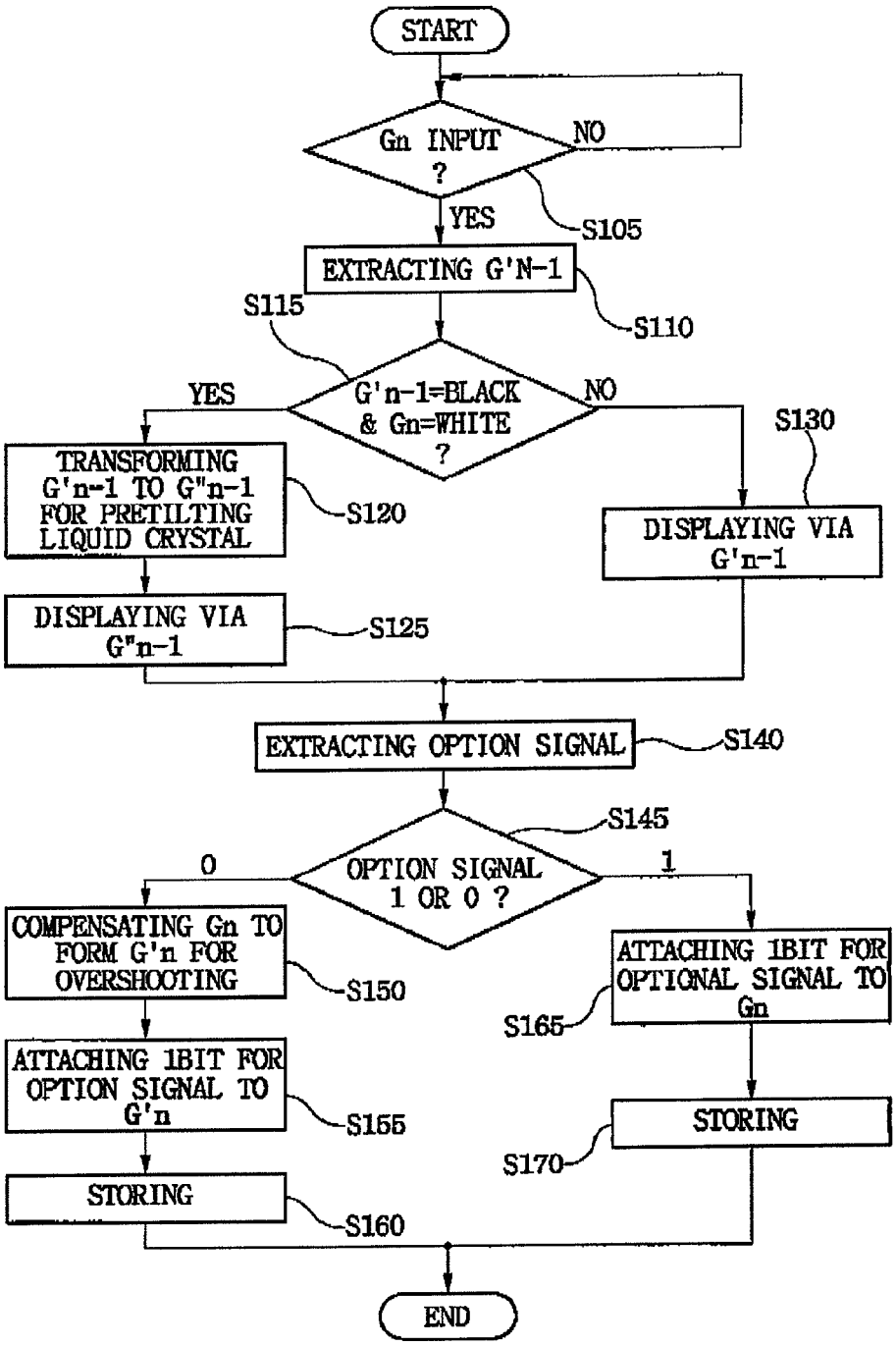
FIG. 10 depicts a flow chart for performing gray scale compensation, in accordance with the fourth embodiment of the present invention.

FIG. 10 is a flow chart showing an operation of the gray scale compensator 500' of FIG. 9. In the step S105, it is determined whether or not the primitive gray scale signal $G_n$ is received. If yes, the first compensated gray scale signal $G'_{n-1}$ is extracted from the frame memory 525 (step S110). For example, when the primitive gray scale signal has 8 bits, the first compensated gray scale signal $G'_{n-1}$ stored in the frame memory 552 has 9 bits, which includes an optional 1 bit signal.

Then, it is determined whether the first condition is satisfied. The first condition is satisfied when the first compensated gray scale signal $G'_{n-1}$ corresponds to black and a primitive gray scale signal $G_n$ corresponds to white (step S115). The gray scale signal $G'_{n-1}$ may correspond to full black color or near black color and the primitive gray scale signal $G_n$ may correspond to full white color or near white color. When the first condition is satisfied, the first compensated gray scale signal $G'_{n-1}$ is transformed to the second compensated gray scale data signal $G''_{n-1}$ (step S120), and an image is display according to the second compensated gray scale signal (step S125). When the first condition is not satisfied, an image is display according to the first compensated gray scale signal $G'_{n-1}$ (step S130).

Then, the option signal is extracted (step S140) from the first compensated gray scale signal $G'_{n-1}$ (step S140). The option signal indicates whether an overshoot wave pattern has occurred or not in the previous frame. The option signal is examined to determine whether or not the option signal is 1 or 0 (step S145). For example, when the option signal is 1, it means that the overshoot wave pattern has been generated in the previous frame. When the option signal of the first compensated gray scale signal $G'_{n-1}$ is 0, it means that an overshoot wave pattern has not been generated in the previous frame. Thus, the gray scale signal $G_n$ is compensated to form the first compensated gray scale signal $G'_n$ for overshooting (step S150). Then, an option signal 1 is attached to the first compensated gray scale signal $G'_n$ (step S155), and the first compensated gray scale signal containing the option signal 1 is stored in the frame memory 525 (step S160). The active option signal stored in the frame memory 525 and the first compensated gray scale signal are used to determine how to generate a gray scale signal for the next frame.

When the option signal of the first compensated gray scale signal $G'_{n-1}$ is 1, it is assumed that an overshoot wave pattern has been generated for the previous frame. Thus, an option signal 0 is attached to the gray scale signal $G_n$ for the present frame (step S165), and the gray scale signal $G_n$ containing the option signal 0 is stored in the frame memory 525 (step S170). The non-active option signal stored in the frame memory 525 and the first compensated gray scale signal are used to determine how to generate a gray scale signal of the next frame.

Figure 11:
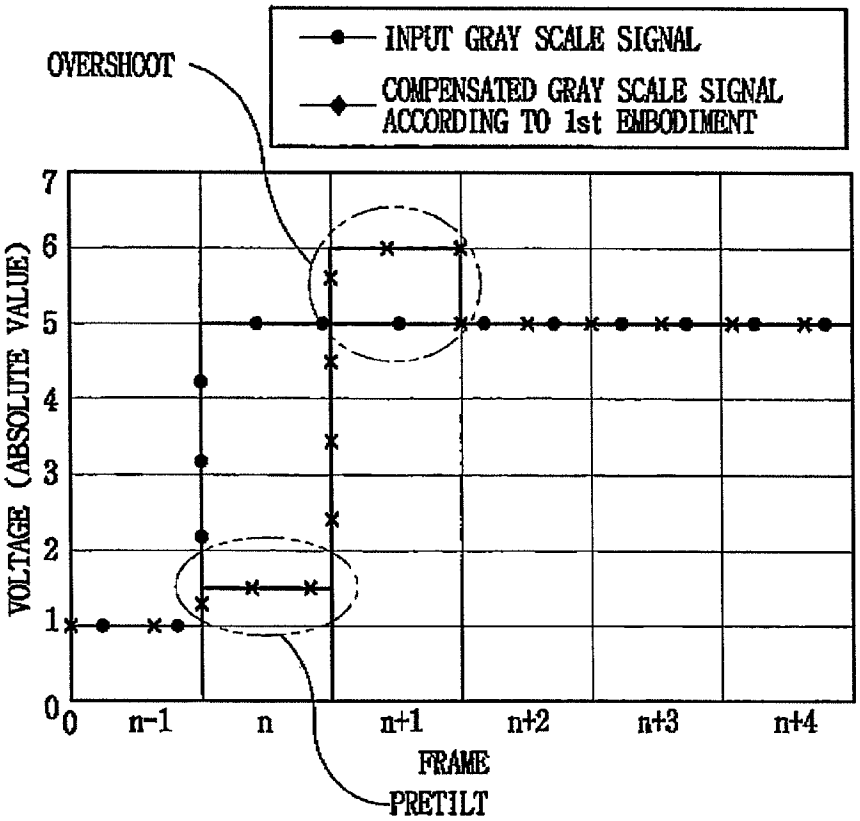
FIG. 11 depicts an input pixel signal and a compensated pixel signal, in accordance with the fourth embodiment of the present invention.

FIG. 11 is a waveform showing a compensated gray scale signal in comparison with a primitive gray scale signal according to the fourth embodiment of the present invention. Referring to FIG. 11, the primitive gray scale signal is about 1V during the (n−1)th frame, about 5V after the (n)th frame is received. The compensated gray scale signal is about 1V during the (n−1)th frame, 1.5V during the (n)th frame for pre-tilting and about 6V during the (n+1)th frame for overshooting. Then, during the (n+2)th frame, the overshoot pattern suppresses. As described above, according to the present invention, a ripple of the compensated gray scale signal is suppressed.

Figure 12:
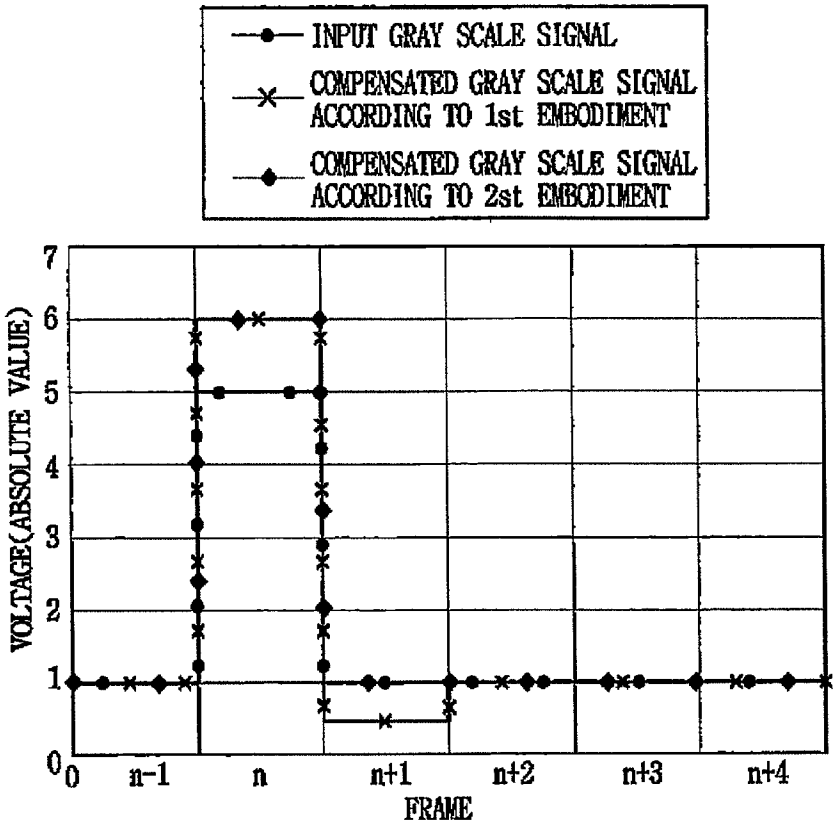
FIG. 12 depicts an input pixel signal and compensated pixel signals generated by the gray level compensators shown in FIG. 7 and FIG. 9.

FIG. 12 is a waveform showing a compensated gray scale signal in comparison with an input gray scale signal according to the second and third exemplary embodiments of the present invention. As shown in FIG. 12, according to the second embodiment, when a gray scale signal changes from black to white abruptly at the (n)th frame, the first overshoot is generated. When a gray scale signal changes from white to black abruptly at the (n+1)th frame, the second overshoot (i.e., undershoot) is formed. Thus, the second overshoot causes a distortion of image, because the gray scale voltage is about 0.5V while the objective gray scale voltage of the (n+1)th frame is about 1V.

However, according to the fourth embodiment of the present invention, when a gray scale signal changes from black to white abruptly at the (n)th frame, the first overshoot is generated. When the gray scale signal changes from white to black abruptly at the (n+1)th frame, the second overshoot (i.e., undershoot) is not generated, which means the input gray scale signal is not compensated. Thus, the present invention prevents a ripple, thereby avoiding image distortion.

As described above, according to the present invention, when a primitive gray scale signal of the previous frame is different from that of the present frame, a compensated gray scale signal, which is higher than the objective gray scale signal, is generated for the next frame to form an overshoot wave pattern. When the gray scale signal of the previous frame corresponds to black and the gray scale signal of the present frame corresponds to white, a pre-tilt signal is generated for the present frame. Thus response time of the liquid crystal molecules decreases and the display quality is enhanced without changing a liquid crystal display panel structure or the liquid crystal property.

Fifth Embodiment

As mentioned before, it has been assumed that a voltage corresponding to black is in a range from about 0.5V to about 1.5V, and the pre-tilt voltage is preferably in a range from about 2V to about 3.5V. Also, a color is represented by 256 levels of a gray scale. Black corresponds to 0th to 50th levels and white corresponds to 200th to 255th level. Of course, a designer may adjust the number of a gray scale levels and the ranges of the levels corresponding to a color. Further, it is possible that a constant voltage is applied regardless of the gray scale level to pre-tilt the liquid crystal molecules and a different voltage may be applied according to a gray scale level. Then, when gray scale data change from black to white color, a response time can be improved. As described above, when a primitive gray scale changes from black to white, compensated gray signals for pre-tilting or overshooting are generated to enhance the response time.

Additionally, a liquid crystal display can adopt an automatic color correction (ACC) for solving problems, such as a visibility difference of red color, green color and blue color, a changing of a color temperature, etc. Thus, image data applied from an external device is separately adjusted in accordance with red, green and blue to represent separate red, green and blue gamma curves into one gamma curve. Thus, the visibility difference and the color temperature change may be solved. Table 1 of below shows a converted data according to a general ACC.

TABLE 1

| INPUT | 10 bits | ACC converted data(10 bits) | | | ACC converted data(8 bits) | | |
|---|---|---|---|---|---|---|---|
| (8 bits) | conversion | R | G | B | R | G | B |
| 0 | 0 | 0 | 0 | 0 | 0 | 0 | 0 |
| 1 | 4 | 4 | 4 | 4 | 1 | 1 | 1 |
| 2 | 8 | 8 | 8 | 7 | 2 | 2 | 1.75 |
| 3 | 12 | 13 | 12 | 11 | 3.25 | 3 | 2.75 |
| 4 | 16 | 17 | 16 | 15 | 4.25 | 4 | 3.75 |
| 5 | 20 | 21 | 20 | 18 | 5.25 | 5 | 4.5 |
| . . . | . . . | . . . | . . . | . . . | . . . | . . . | . . . |
| 250 | 1000 | 1004 | 1000 | 992 | 251 | 250 | 248 |
| 251 | 1004 | 1007 | 1004 | 998 | 251.75 | 251 | 249.5 |
| 252 | 1008 | 1010 | 1008 | 1003 | 252.5 | 252 | 250.75 |
| 253 | 1012 | 1014 | 1012 | 1009 | 253.5 | 253 | 252.25 |
| 254 | 1016 | 1017 | 1016 | 1014 | 254.25 | 254 | 253.5 |
| 255 | 1020 | 1020 | 1020 | 1020 | 255 | 255 | 255 |

However, as shown in Table 1, according to the conventional ACC scheme, the gray scale data with 255 gray levels is converted into 10 bits to generate gray scale data with 1020 gray levels. Then, the data with 1020 gray levels undergoes the ACC and is represented in 8 bits by a dithering method. The data corresponding to the highest 255 gray scale are not changed, even when the data undergoes the ACC because the data corresponding to 255th gray scale are converted into full white color corresponding to 1020 gray scale.

Thus, when gray scale data corresponding to the full white of a 255th gray scale are received, an overshoot voltage may not be applied. Thus, there is a need for improved liquid crystal response time. To solve this problem, this embodiment provides a liquid crystal display apparatus that reduces the liquid crystal response time even when a gray scale data corresponding to full gray scale is inputted. Also, this embodiment provides a method of driving the liquid crystal display apparatus.

Figure 13:
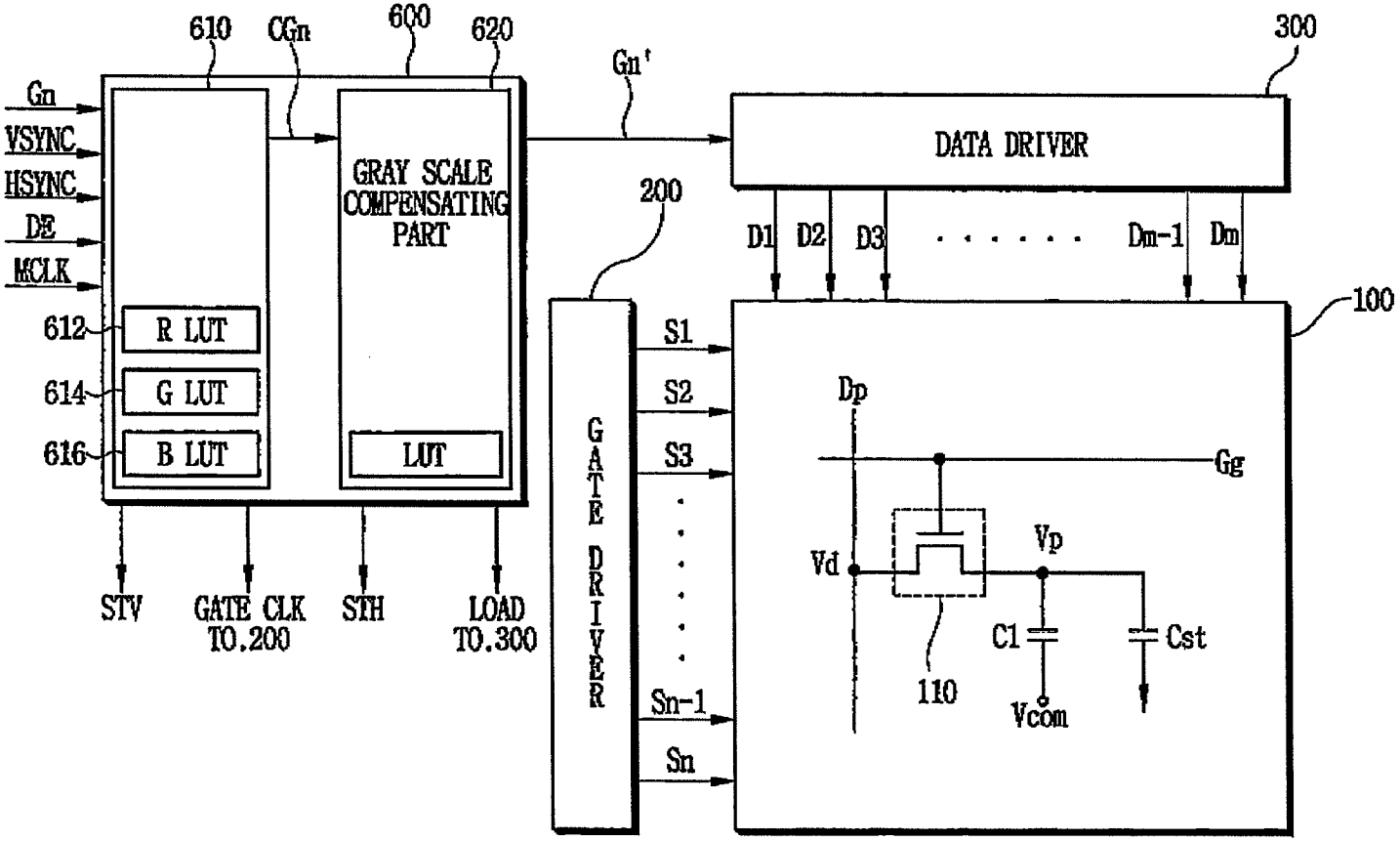
FIG. 13 depicts a block diagram of a liquid crystal display including a color compensating part and gray scale compensating part, in accordance with the fifth embodiment of the present invention.
Figure 14:
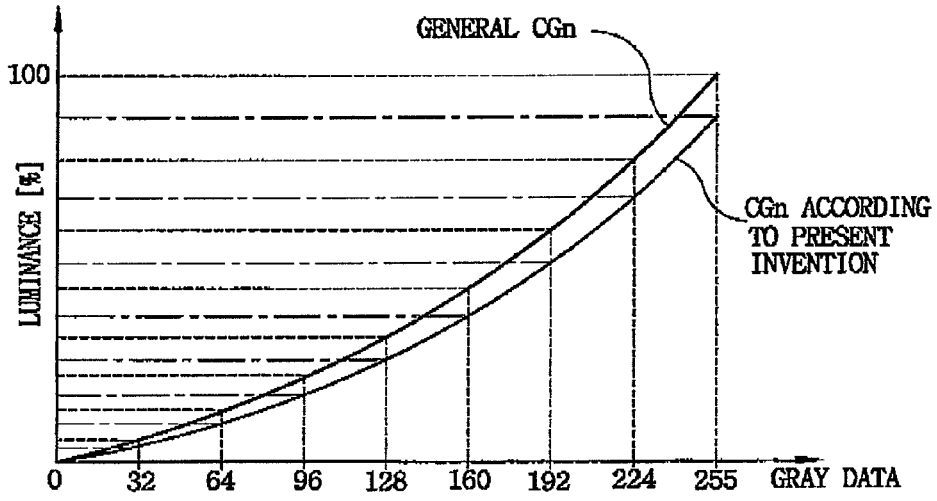
FIG. 14 depicts a gamma curve transformed by the color compensating part of FIG. 13.

FIG. 13 is a block diagram showing a liquid crystal display apparatus according to the fifth embodiment of the present invention. The liquid crystal display apparatus includes a liquid crystal display panel 100, a gate driver 200, a data driver 300 and a timing control part 600. The gate driver 200, the data drivers 300 and the timing control part 400 operate as a driving device that converts a signal provided from an external host to a signal that is suitable for the liquid crystal display panel 100.

The liquid crystal display panel 100 may be the same as the liquid crystal display panel 100 shown in FIG. 4. The timing controller 600 receives the first timing control signal Vsync, Hsync, DE and MCLK and provides the second timing control signal Gate Clk and STV to the gate driver 200 and the third timing control signal LOAD and STH to the data driver 300. The timing control part 600 includes an auto color compensator 610 and a gray scale data compensating part 620. When the timing controller 600 receives a primitive gray scale data signal $G_n$ from a gray scale signal source, the timing controller 600 pulls down a peak value of full gray scale corresponding to the primitive gray scale signal, and the timing controller 600 provides the data driver 300 with a compensated gray scale signal $G'_n$ by considering the pulled down gray scale signal and the previous gray scale signal.

In detail, the auto color compensator 610 converts a $2^k$ full gray scale signal of k-bits (wherein 'k' is a natural number) to a $2^{k+p}-r$ full gray scale data of (k+p) bits (wherein 'r' is a natural number that is smaller than 'k') by bit expansion, and coverts the $2^{k+p}-r$ full gray scale data of (k+p) bits to $2^{k+p}-r$ full gray scale data of k bits. That is, when a primitive gray scale data $G_n$ is received, the auto color compensator 610 provides the gray scale data compensating part 620 with a color compensated gray scale data signal $CG_n$. The color compensated gray scale data signal $CG_n$ is generated based on a red lookup table 612, a green lookup table 614 and a blue lookup table 616. The red lookup table 612 stores red colored gray scale data of the primitive gray scale data, the green lookup table 614 stores green colored gray scale data of the primitive gray scale data, and the blue lookup table 616 stores blue colored gray scale data of the primitive gray scale data. For example, Table 2 of below shows each of red, green and blue lookup tables.

TABLE 2

| INPUT | 10 bits | ACC converted data(10 bits) | | | ACC converted data(8 bits) | | |
|---|---|---|---|---|---|---|---|
| (8 bits) | conversion | R | G | B | R | G | B |
| 0 | 0 | 0 | 0 | 0 | 00 | 00 | 00 |
| 1 | 4 | 4 | 4 | 4 | 1.00 | 1.00 | 1.00 |
| 2 | 8 | 8 | 8 | 7 | 2.00 | 2.00 | 1.75 |
| 3 | 12 | 13 | 12 | 11 | 3.25 | 3.00 | 2.75 |
| 4 | 16 | 17 | 16 | 15 | 4.25 | 4.00 | 3.75 |
| 5 | 20 | 21 | 20 | 18 | 5.25 | 5.00 | 4.5 |
| . . . | . . . | . . . | . . . | . . . | . . . | . . . | . . . |
| 250 | 1000 | 992 | 988 | 980 | 248.00 | 247.00 | 245.00 |
| 251 | 1004 | 995 | 992 | 986 | 248.75 | 248.00 | 246.50 |
| 252 | 1008 | 998 | 996 | 991 | 249.50 | 249.00 | 246.75 |
| 253 | 1012 | 1002 | 1000 | 997 | 250.50 | 250.00 | 249.25 |
| 254 | 1016 | 1005 | 1004 | 1002 | 251.25 | 250.00 | 250.50 |
| 255 | 1020 | 1008 | 1008 | 1008 | 252.00 | 252.00 | 252.00 |

For example, when the present primitive gray scale data having 8 bits red, green and blue gray scale signals, respectively, is received in accordance with a 250 gray scale, each of the red, green and blue gray scale signals is expanded to be 10 bits. That is, the present red primitive gray scale data signal is converted to a value that corresponds to 992, a present red primitive gray scale data signal is converted to a value that corresponds to 998, and a present blue primitive gray scale data signal is converted to a value that corresponds to 980.

Then, each converted value is reduced to 8 bits so that the present color compensated gray scale signal $CG_n$ corresponding to red color becomes 248.00, a present color compensated gray scale signal $CG_n$ corresponding to a green color becomes 247.00, and a present color compensated gray scale signal $CG_n$ corresponding to a blue color becomes 245.00. The present color compensated gray scale signals $CG_n$ corresponding to red, green and blue colors are provided to the gray scale data compensating part 620. Theses exemplary values do not have any problem even without decimal values. When the color compensated gray scale signal $CG_n$ has the decimal values, the color compensated gray scale signals $CG_n$ pass through dithering or FRC conversion to be same bits. That is, in above ACC, the additional bits are added to input signal, and then the input signal including the additional bits is converted. The converted signal is lowered to have same number of bits as the input signal, and the input signal is used to display an image via the dithering method. Thus, a loss of the gray scale signal is compensated via dithering method.

Figure 15:
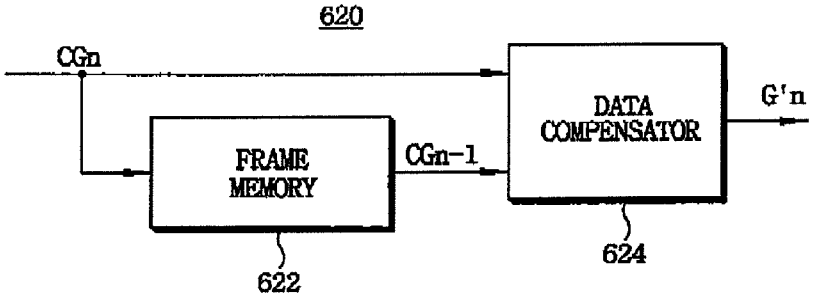
FIG. 15 depicts a block diagram showing a gray scale data compensating part, in accordance with the fifth embodiment of the present invention.

FIG. 15 is a graph showing a gamma curve transformed by an auto color compensating part. Referring to FIG. 15, a level of a gamma curve processed by an auto color compensating part of the present invention is lowered in comparison with a general gamma curve. That is, in a low gray scale level from 0 to $32^{nd}$, the gamma curve processed by the auto color compensating part is substantially same as the general gamma curve. However, as the gray scale level increases, the difference between the gamma curve processed by the auto color compensating part and the general gamma curve increases also.

As described above, according to the lookup table for the ACC converting, even when the 255th gray scale data is received, a gray level of the 252nd level is generated. Thus, when the 255th gray scale data is received, a color compensated gray scale data outputted via the ACC conversion becomes the 252nd gray scale data that is lower than the 255th gray scale data. Thus, there is a gray scale that is higher than a gray scale corresponding to full white color so that the gray scale data compensator 620 has a margin for the gray scales from the 253rd to 255th, which may be used for overshooting. Thus, even when a full gray scale is inputted, a response time of liquid crystal may be reduced.

The gray scale data compensator 620 generates a compensated gray scale data $G'_n$ for reducing the liquid crystal response time corresponding to $2^{k+p}-r$ gray scale data (wherein 'k', 'p' and 'r' are natural numbers, 'r' is smaller than 'k') and a compensated grays scale data $G'_n$ corresponding to 'r' gray scale data. As shown in FIG. 15, the gray scale data compensator 620 has a frame memory 622 and a data compensator 624. The color compensated gray scale signal $CG_n$ is applied to the frame memory 622 and the data compensator 624. The gray scale data compensator 620 generates a compensated gray scale signal $G'_n$ by considering the previous color compensated gray scale signal $CG_{n-1}$ and the present color compensated gray scale signal $CG_n$, and the gray scale data compensator 620 provides the data driver 300 with the compensated gray scale signal $G'_n$.

That is, when the present color compensated gray scale signal is substantially same as the previous gray scale signal $CG_{n-1}$ the present color compensated gray scale signal is not compensated. However, when the previous color compensated gray scale signal $CG_{n-1}$ corresponds to black and the present color compensated gray scale signal $CG_n$ corresponds to white, a compensated gray scale signal, that is higher than the black gray scale signal, is generated for the present frame. In detail, the frame memory 622 stores a color compensated gray scale signal $CG_n$ for a single frame. When a color compensated gray scale signal $CG_n$ is received, the frame memory 622 generates the previous compensated gray scale signal CGn−1, and the color filter substrate $CG_n$ is stored in the frame memory 622. An SRAM may be used as the frame memory 622.

The data compensator 624 stores a plurality of compensated gray scale data $G'_n$, which is lower or higher than the object pixel voltage and optimizes the rising time or falling time. For example, when the a color compensated gray scale data signal $CG_{n-1}$ for the present frame is substantially same as a color compensated gray scale data signal $CG_n$ for the present frame, the data compensator 620 does not make any compensation. However, the color compensated gray scale data signal $CG_{n-1}$ for the present frame corresponds to black and the color compensated gray scale data signal $CG_n$ for the present frame corresponds to white, the data compensator 620 generates a compensated gray scale data $G'_n$ corresponding to a gray level brighter than black.

That is, the compensated gray scale data $G'_n$ for forming an overshoot wave pattern is formed by comparing the color compensated gray scale signal $CG_n$ of the present frame and the color compensated gray scale signal $CG_{n-1}$ of the previous frame is generated. Additionally, when the compensated gray scale signal $CG_{n-1}$ for the previous frame corresponds to white and the compensated gray scale signal $CG_n$ of the present frame corresponds to black a compensated gray scale signal $G'_n$ for forming an undershoot wave form is generated to form a gray level that is darker than white.

As described above, according to the present invention, a color compensated gray scale data is compensated to be applied to pixels, so that a pixel voltage arrives at the desired level. Thus, without altering the liquid crystal display panel structure or the liquid crystal material property, a response time is improved to display moving pictures better. In other words, in case of a general liquid crystal display apparatus, 255 gray scales are fully used to represent a gray scale, but in the present invention, only 252 gray scales are used to represent a gray scale, and 3 gray scales are used to form an overshoot. Of course, the steps of the gray scale is more or less than 252.

As explained above, gray scale loss is overcome by dithering of ACC. The driving voltage is raised to overcome a lowering of luminance, so that a voltage corresponding to a general full white is generated. For example, a source voltage AVDD for generating a gray scale voltage is set to 10.5V, and 255 gray scales are received. However, in the present invention, when the source voltage AVDD is set to 11.5V and 245 gray scales becomes 5.25V, 245 gray scales is used for white, and the remaining gray scales are used for overshoot.

A display quality may be deteriorated due to the reduced number of steps in gray scale, when ACC is performed. Thus, a dithering conversion or FRC conversion may be performed to overcome the deterioration. When a full gray scale signal that undergoes ACC conversion becomes similar to a full gray scale signal before ACC conversion, the display quality is less deteriorated. For example, when a gray scale before ACC conversion is 255 gray scale, a gray scale that undergoes ACC conversion approaches to 255 gray scales to prevent deterioration.

Figure 16:
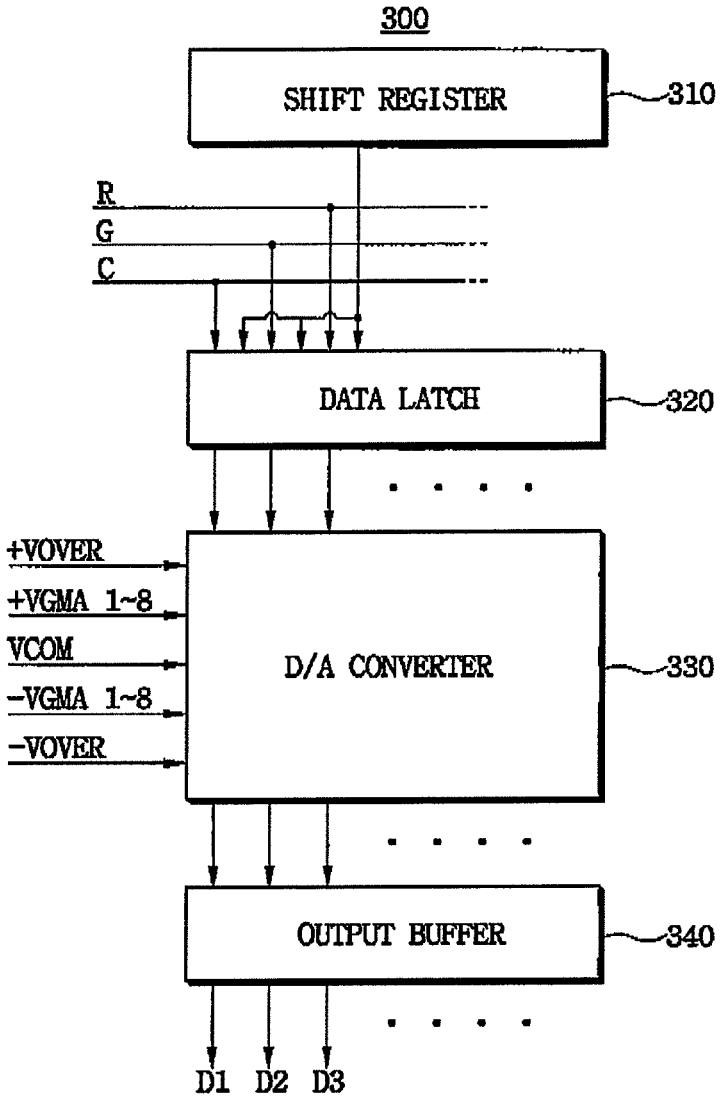
FIG. 16 depicts a block diagram showing the data driver shown in FIG. 13.
Figure 17:
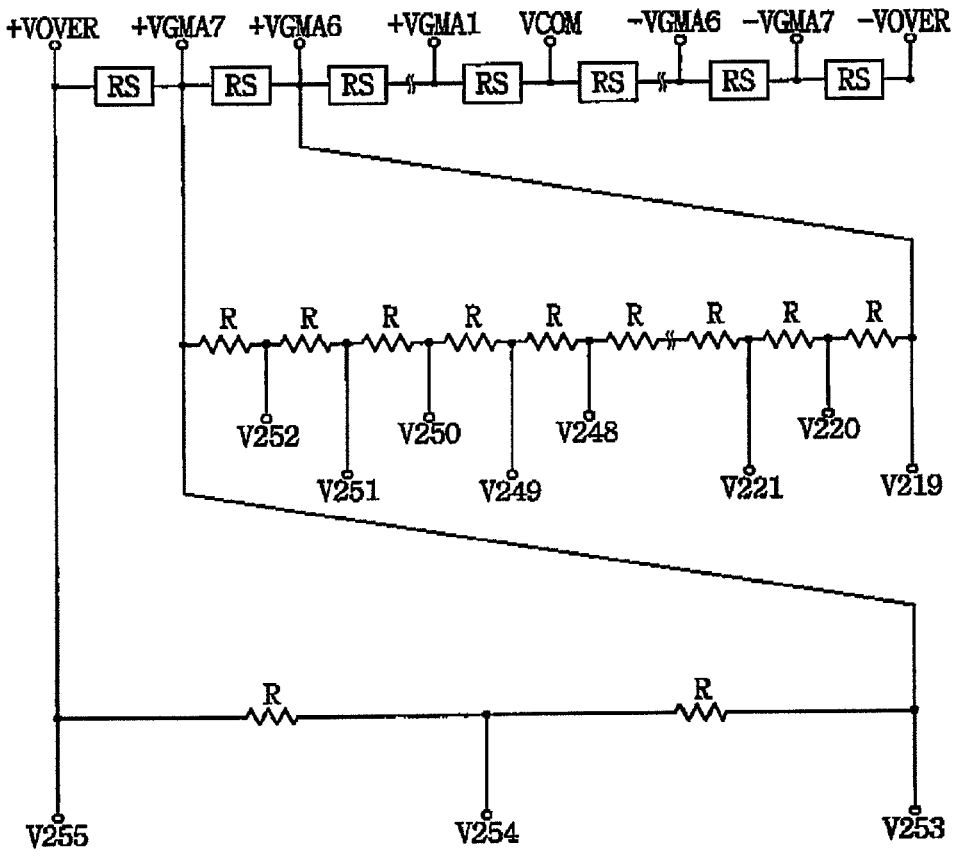
FIG. 17 depicts a circuit diagram showing the D/A converter shown in FIG. 16.

The present invention provides an example of a modified data driver structure. FIG. 16 is a block diagram showing a data driver of FIG. 13 and FIG. 17 is a schematic circuit diagram showing a D/A converter of FIG. 16. Referring to FIGS. 13, 16 and 17, a data driver according to this embodiment includes a shift register 310, a data latch 320, a D/A converter 330 and an output buffer 340. The data driver applies a data voltage (or gray scale voltage) to the data lines. The shift register 310 generates shift clock signal and the shift register 310 shifts the compensated gray scale data $G'_n$ of red, green and blue colors to provide the data latch 320 with the compensated gray scale data $G'_n$. The data latch 320 stores the compensated gray scale data G'n and provides the D/A converter 330 with the compensated gray scale data $G'_n$.

The D/A converter 330 includes a plurality of resistors RS and coverts the compensated gray scale data G'n into an analog gray scale voltage to provide the output buffer 340 with the analog gray scale voltage. The D/A converter 330 receives 16 gamma reference voltages VGMA1, VGMA2, VGMA3, VGMA4, VGMA5, VGMA6 and VGMA7, and two overshoot reference voltages VOVER and +VOVER. The D/A converter 330 distributes them to generate 256 gray scale voltages. The D/A converter 330 provides the output buffer 340 with the gray scale data voltage corresponding to red, green and blue gray scale voltages. For example, the 256 gray scale voltages include 254 voltages for representing a gray scale and two voltages for overshooting.

A common electrode voltage VCOM is applied to the center of the resistor series. Positive gamma reference voltages +VGMA1 to +VGMA7 are applied to the resistor series in a first direction, respectively, and negative gamma reference voltages −VGMA1 to −VGMA7 are applied to the resistor series in a second direction, respectively. A positive overshoot voltage +VOVER is applied to the first end of the first direction and a negative overshoot voltage −VOVER is applied to the second end of the second direction.

The resistor series includes a plurality of resistors connected to each other. Each resistor outputs a gray scale through a node. Especially, the end portion of the resistor series includes two resistors. The end portion receives the positive overshoot voltage +VOVER and the positive seventh gamma reference voltage +VGMA7 to output data voltages V253, V254 and V255 corresponding the 253rd gray scale, the 254th gray scale and the 255th gray scale, respectively. That is, in order to represent 256 gray scales, 8 resistor series are required, wherein each resistor series includes 32 resistors (or 16 resistor series are required, wherein each resistor series includes 16 resistors). However, according to the present invention, only one or two resistors are defined as resistor series, and six resistor series (or 12 resistor series) include remaining 31 or 30 resistors. Thus, the data driver for reducing response time does not require additional resistors.

In FIG. 17, two resistors are used for the resistor series of positive and negative, respectively, to generate two overshoots. However, one resistor may be used for the resistor series of positive and negative, respectively. Alternately, three or four resistors may be used for the resistor series to generate three or four overshoots. The output buffer 340 applies analog gray scale signal to the data lines. As described above, a portion corresponding to one or two gray scales is separated from the resistor series of the D/A converter. According to the present invention, a portion of a number of a primitive gray scale signal is compensated and the remaining portion of the number of the primitive gray scale signal is used for overshooting. Thus, a response time of liquid crystal is reduced.

While the invention has been described in terms of embodiments, those skilled in the art will recognize that the invention can be practiced with modifications and in the spirit and scope of the appended claims.

What is claimed is:

1. A display apparatus comprising:

a driving device configured to:

use a lookup table that maps all grey levels of a first range to a corresponding color corrected gray scale signals in a second range, wherein each range comprises a same lower limit corresponding to a 0% pixel transmittance, the first range comprises a first upper limit corresponding to a full-white color, and the second range comprises a second upper limit lower than the first upper limit that corresponds to the full-white color;

compare a first pixel signal of the color corrected gray scale signals for an n-th frame with a gray level of a second pixel signal of the color corrected gray scale signals for an (n−i)-th frame and use the first pixel signal to generate a compensated first pixel signal;

a display panel configured to display an image based on the compensated first pixel signal; and wherein the compensated first pixel signal has a voltage level higher than a voltage level at which the image has the first upper limit, wherein a gray level of the compensated first pixel signal is higher than the second upper limit, wherein each range is represented by a same number of bits.

2. The display apparatus of claim 1, wherein the driving device comprises:

a converter configured to (a) receive the first and second pixel signals, the first and second pixel signals corresponding to first gray levels within a first grayscale range having an X number of gray levels, and (b) convert the first gray levels of the first and second pixel signals into second gray levels within a second grayscale range having a Y number of gray levels and at least one overshooting gray level, wherein the at least one overshooting gray level has a voltage level higher than a voltage level of a highest gray level of the second grayscale range.

3. The display apparatus of claim 2, wherein the driving device further comprises:

a compensator configured to determine if the second gray levels of the first and second pixel signals satisfy a predetermined condition and compensating the second gray level of the first pixel signal if the predetermined condition is satisfied.

4. The display apparatus of claim 3, wherein the predetermined condition is satisfied if the second gray level of the second pixel signal corresponds to a first color and the second gray level of the first pixel signal corresponds to a second color substantially whiter than the first color.

5. The display apparatus of claim 4, wherein the compensator is configured to increase the second gray level of the first pixel signal to the overshooting gray level to generate the compensated first pixel signal.

6. A display apparatus comprising:

a driving device configured to reduce an original gray level of an input pixel signal of a first voltage level to a reduced gray level using a lookup table that maps all grey levels of a first gray scale range to a corresponding gray level in a second grayscale range, wherein the first grayscale range comprises a first upper limit corresponding to a full-white color, and the second grayscale range comprises a second upper limit lower than the first upper limit that correspond to the full-white color, the original gray level corresponding to the first upper limit; and a display panel configured to display a full-white color upon receipt of the pixel signal with the reduced gray level; and wherein the driving device is configured to compare a gray level of a first pixel signal for an n−th frame with a gray level of a second pixel signal for an (n−i)-th frame to determine whether the first pixel signal needs to be compensated, apply the first pixel signal to the display panel when compensation is not needed during an image period, and apply a compensated first pixel signal at a second voltage level higher than the first voltage level to the display panel when compensation is needed during the same image period, wherein each grayscale range is represented by a same number of bits.

7. The display apparatus of claim 6, wherein the driving device determines that the first pixel signal needs to be compensated when the first pixel signal is the first voltage level and the second pixel signal is at a voltage level for driving the display panel with a 0% pixel transmittance.

8. The display apparatus of claim 6, wherein the driving device comprises:

a converter configured to (a) receive the first and second pixel signals, the first and second pixel signals corresponding to first gray levels within a first grayscale range having an X number of gray levels, and (b) convert the first gray levels of the first and second pixel signals into second gray levels within a second grayscale range having a Y number of gray levels and at least one overshooting gray level, wherein the at least one overshooting gray level has a voltage level higher than highest gray level of the second grayscale range.

* * * * *